US006612037B2

(12) United States Patent
Carro et al.

(10) Patent No.: US 6,612,037 B2
(45) Date of Patent: Sep. 2, 2003

(54) REPLACEABLE NOSE MEMBER FOR CHAIN SAW GUIDE BARS

(75) Inventors: Gabriel Carro, Jackson, TN (US); Karl Erik Forsberg, Oesthammar (SE); Karl Olov Pettersson, Voxnabruk (SE); Larry Flowers, Dyer, TN (US); Paul E. Wade, Milan, TN (US)

(73) Assignee: Blount, Inc., Montgomery, AL (US)

( * ) Notice: Subject to any disclaimer, the term of this patent is extended or adjusted under 35 U.S.C. 154(b) by 16 days.

(21) Appl. No.: 10/058,356

(22) Filed: Jan. 30, 2002

(65) Prior Publication Data

US 2002/0116830 A1 Aug. 29, 2002

Related U.S. Application Data

(63) Continuation-in-part of application No. 09/619,571, filed on Jul. 19, 2000, now abandoned.

(51) Int. Cl.[7] ..... B27B 17/02
(52) U.S. Cl. ..... 30/384; 30/387
(58) Field of Search ..... 30/383, 384, 387; 83/825

(56) References Cited

U.S. PATENT DOCUMENTS

| | | | | |
|---|---|---|---|---|
| 596,802 A | | 1/1898 | Brown et al. | |
| 2,693,206 A | | 11/1954 | Anttonen | |
| 3,955,279 A | * | 5/1976 | Pierson | 30/384 |
| 3,987,544 A | * | 10/1976 | Gibson | 30/384 |
| 4,060,895 A | | 12/1977 | Hille | |
| 4,259,783 A | | 4/1981 | Scott-Jackson et al. | |
| 4,956,918 A | | 9/1990 | Beyer | |
| 6,247,544 B1 | | 6/2001 | Beebe | |

FOREIGN PATENT DOCUMENTS

| | | |
|---|---|---|
| CA | 493 111 | 5/1953 |

* cited by examiner

*Primary Examiner*—Douglas D. Watts
(74) *Attorney, Agent, or Firm*—Burns, Doane, Swecker & Mathis, LLP

(57) ABSTRACT

A chainsaw guide bar includes a bar body and a nose member removably attached to the bar body by an elastic snap-in coupling, eliminating the need for separate fastening elements. The snap-in coupling includes dimples formed in tongues of the nose member, the dimples being received in holes formed in a web of the bar body. The dimpled portions of the tongues are elastically flexible in a thickness direction of the guide bar to enable the nose member to be inserted or removed.

20 Claims, 2 Drawing Sheets

Fig. 1
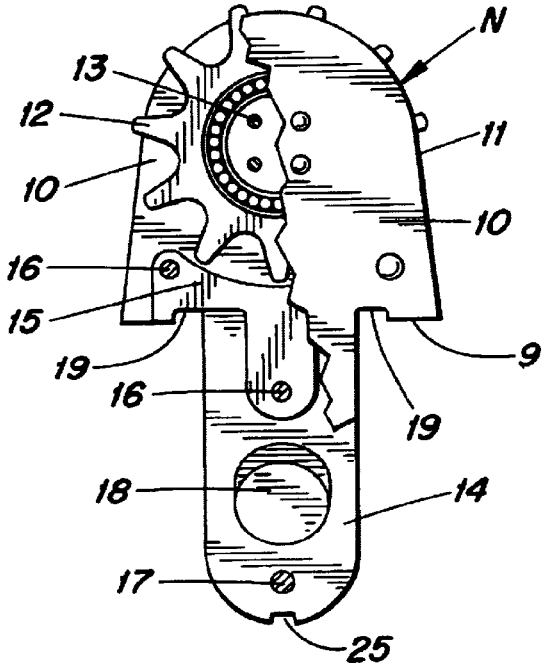
Fig. 3
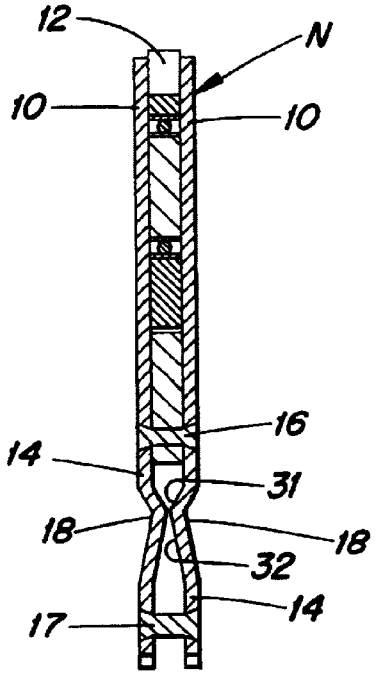
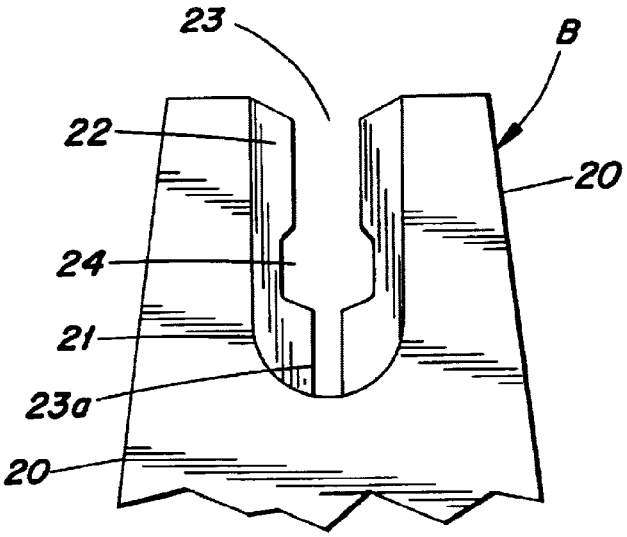
Fig. 2
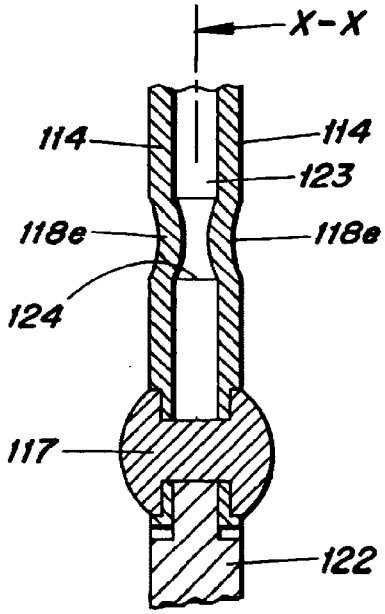
Fig. 7

REPLACEABLE NOSE MEMBER FOR CHAIN SAW GUIDE BARS

This is a continuation-in part of U.S. application Ser. No. 09/619,571 filed Jul. 19, 2000, and now abandoned.

BACKGROUND OF THE INVENTION

The present invention relates to chain saw guide bars and, in particular, to a replaceable nose member for a chain saw guide bar.

It is well known in the prior art to provide chain saw guide bars with separate nose members, because the nose member preferably has a considerably different structure as compared to the body of the guide bar. That is, a nose member is more dependable if made from a number of thinner plates which have smooth contact surfaces bearing against a nose sprocket, or against a nose wheel and its bearing parts, whereas the body of the guide bar is stronger and stiffer if it is made from one thick plate rather than a number of thinner plates welded, riveted or laminated together.

It is also an advantage to be able to replace a nose member since the nose sprocket or its bearing is worn out or damaged in service more often than the guide bar body. The nose member is therefore commonly made as a separate item which can be slid into place and fastened to the guide bar body.

The saw chain can be fractured in service if it encounters nails or other hard objects, and may then fall off. To avoid losing the nose member in case the chain falls off, it has been traditional to attach the nose member to the guide bar body by rivets as disclosed in U.S. Pat. No. 596,802 and later patents. When the nose member is to be replaced, the rivets have to be removed by drilling, and other rivets have to be set to attach a new nose member. Consequently, exchange of such a nose member cannot be done in the field. A tight attachment will also reduce vibrations and noise, and preserve the continuity of the peripheral groove.

Alternative fastening methods have been suggested, such as attaching the nose member by a rotatable claw or other reusable element as in U.S. Pat. No. 4,956,918. Holding the nose member in place by a tight press fit was suggested in U.S. Pat. No. 2,693,206. Press fit as well as screws have found very little practical application, since the extreme vibrations tend to loosen such connections and make them unreliable. An elastic wedge-shaped center plate was suggested in CA 493,111, but will be extremely sensitive to vibrations, since the wedge action will make the force needed to release the nose member much smaller than the force needed to mount it.

It has also been proposed to secure a nose member by a snap-in connection which includes hook-shaped ears that flex elastically in a direction within the plane of the guide bar, i.e., perpendicular to a thickness direction of the guide bar, e.g., see U.S. Pat. No. 4,060,895. However, the ears must inherently be thin and thus may not be sufficiently sturdy to withstand out-of-plane deflections of the nose member. Also, out-of-plane deflections of the nose member could damage the ears.

SUMMARY OF THE INVENTION

The present invention involves attaching a replaceable nose member to a guide bar body by a snap-in coupling, requiring no parts such as fasteners, that could be lost or loosened by vibration, while allowing replacement of a nose member in the field using no tools more complicated than a screwdriver. The present invention relates to a chainsaw guide bar which comprises a guide bar body and a replaceable nose member. The nose member has two rearward tongues spaced apart in a thickness direction of the nose member. The body has a web which fits between the tongues. The nose member is held in place by an elastic snap-in coupling. The snap-in coupling comprises spring portions defined by indentations formed in respective ones of the tongues and projecting toward the web. The web includes a cut-out arrangement for receiving the indentations. The spring portions are elastically flexible in a thickness direction of the guide bar for enabling the indentations to be slidable into place and out of place without adding or removing any fastening element.

Preferably, there is a plurality of indentations formed in each of the tongues on opposite sides of the center axis. The cut-out arrangement preferably comprises through-holes formed in the web, and positioned to receive the indentations.

A space is preferably formed between the nose member and the bar body for receiving a prying tool.

The invention also pertains to a nose member whose tongues include dimples formed on opposite sides of a center axis of the nose member.

BRIEF DESCRIPTION OF THE DRAWINGS

Preferred embodiments of the invention will be described below with reference to the figures, where FIG. 1 shows a partially broken-away view of a replaceable nose member according to a first embodiment of the invention;

FIG. 2 shows the front end of a guide bar body onto which the replaceable nose member can be attached;

FIG. 3 shows a longitudinal section through the replacement nose member of FIG. 1;

FIG. 7 is a sectional view taken along the lines VII—VII of FIG. 6.

DETAILED DESCRIPTION OF PREFERRED EMBODIMENTS OF THE INVENTION

Figure 4:
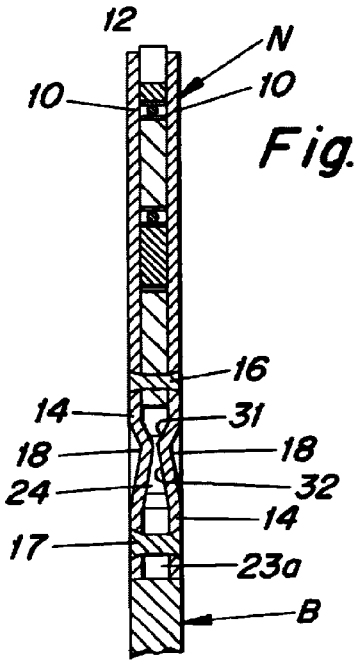
FIG. 4 is a view similar to FIG. 3 showing the nose member attached to a guide bar body.

A first embodiment of the invention is depicted in FIGS. 1–4. A replaceable nose member N according to the invention comprises two side plates (10) having a front contour (11) and a width and direction such that a saw chain running along the guide bar will transfer to the nose member without any impact or loss of guidance. Between the side plates is a rotatable sprocket (12) rotatable on a roller bearing having an inner race fastened to the side plates by rivets (13). The rear ends of the side plates are made as tongues (14) having a smaller width than the front region of the side plates or the guide bar body. Concave corners (19) are formed on a rear transverse edge (9) of the wider front region. Between the sprocket and the tongues is a middle plate (15). The width of the middle plate is smaller than the width of the side plates, to allow drivelinks of the saw chain to enter between side plates. The middle and side plates are held together with rivets (16) or spot welds. The rearmost part of the tongues may be held at proper distance by a rivet (17).

FIG. 2 shows the front end of a guide bar body B according to the invention, with two longitudinal edges (20) along which the saw chain will run with drive links in a groove along the edges, and with milled recesses (21) on both flat sides to receive the tongues (14) of the nose member. Between the milled recesses, the base material remains as a web (22) with a thickness corresponding to the thickness of the middle plate (15). The web is preferably made with a slot (23) to simplify mounting of a new nose member by accommodating the rivet (17) and the rearmost rivet (16). The rear end **(23*a*) of the slot 23 narrows in width and receives the rivet (17)**.

The recesses (21) and the tongues (14) are made with similar shape and dimensions to make it possible to slide the nose member off or onto the guide bar body, with the tongues basically filling the recesses. There should, however, be some elastically deformable portion of the web (22) or the tongues (14) or both, co-operating to offer more resistance when the tongues are nearly filling the recesses, especially resistance against sliding the nose member off the guide bar body. If the elastically deformable portion is to be a portion of the tongues (14), then the rivets (16, 17) through the tongues should be far apart to provide enough elasticity.

One embodiment of this is shown in FIGS. 2 and 3, where elastic deformation occurs in the thickness direction of the guide bar (i.e., perpendicularly to a plane of the nose member), the deformation occurring particularly in the tongues (14). The web (22) is provided with a space formed by a cutout (24) which may be connected to the slot (23). The tongues are made with indentations (18) corresponding to the cutout. The indentations are located at such a distance from the rivets (16, 17) that the tongues may be bent elastically apart by the web to make room for the thickness of the web. Eventually, the tongues snap back into the cutouts (24) to create a snap-in coupling (see FIG. 4). The indentations are made with sloping sides (31, 32) such that they will be pried apart when the indentations (18) are forced to move relative to the cutout (24). The force needed to do that depends on the degree of slope, and by choosing a steeper slope at the front side (31) and a gentle slope at the rear side (32) it is ensured that the initial force to move the nose member off the guide bar body B is so much higher than the force needed to slide a new nose member onto the guide bar body B, that there is no risk of the nose member falling off in case the chain breaks.

Figure 5:
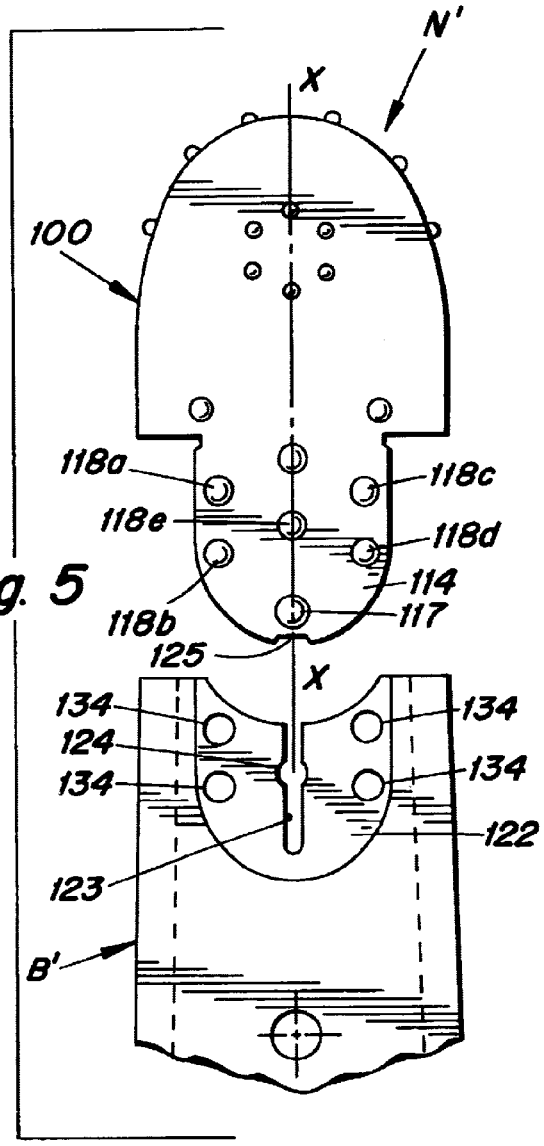
FIG. 5 is an exploded view of a second embodiment of the invention.
Figure 6:
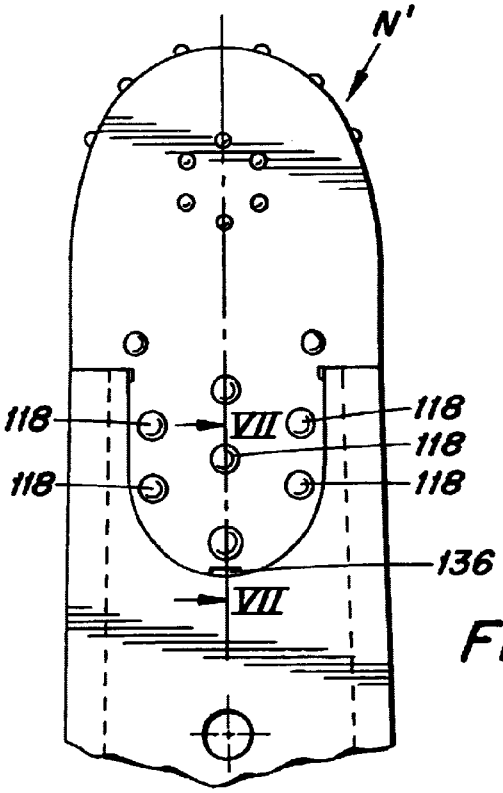
FIG. 6 is a view similar to FIG. 5 with the nose member attached to a guide bar body.

Another embodiment of the invention is shown in FIGS. 5–7 wherein a plurality of indentations are provided, instead of only a single indentation. In that embodiment, a nose member N' includes two side plates (100) having respective tongues (114). The side plates are held together by rivets including a rear post or rivet (117) extending through the tongues. The nose member defines a longitudinal center axis X—X. Formed in each tongue is a plurality of indentations, in the form of dimples 118 projecting toward the opposite tongue (see FIG. 6). In accordance with this embodiment of the invention, there are dimples located to each side of the axis X—X. As depicted in FIGS. 5–7, each tongue has five dimples, i.e., two dimples **(118*a*, 118*b*) disposed to one side of the axis X—X, two dimples (118*c*, 118*d*) disposed to the other side of the axis, and one dimple (118*e*) disposed on the axis (see FIGS. 5 and 7**). Fewer or more dimples could be provided, as desired.

The guide bar body B' includes a web (122) having a cut-out arrangement for receiving the dimples. The cut-out arrangement comprises spaces formed by holes (134) which are located in corresponding fashion to the dimples **(118*a*–118*d*) to receive same. Thus, two holes (134) are located on each side of the axis X—X. In addition, the web (122) includes a center slot (123) that is open at its front end to receive the rivet (117) when the nose member is slid onto the web. That slot (123) includes an additional cut-out space (124) arranged to receive the fifth dimple (118*e*). Each of the holes (134)** preferably extends completely through the web (i.e., it constitutes a through-hole), so that both ends of each hole are able to receive dimples (the dimples of each tongue being aligned with respective dimples of the other tongue in the thickness direction of the nose bar).

It will be appreciated that the dimpled areas of the tongues will elastically flex in the thickness direction of the guide bar when the nose member is pushed onto, or pulled from, the web (122), in order to engage (or disengage) the dimples with respect to their respective through-holes (134).

It has been learned through testing that by providing a securement of the nose member by a snap-in connection, wherein a part of the connection flexes in the direction of the thickness of the guide bar, a more reliable securement is achieved as compared to a securement wherein a locking member flexes in a direction within a plane of the guide bar. It has also been learned that the provision of indentations on both sides of the center axis intensifies the securement.

To remove the nose member, it is merely necessary to insert a prying member into a space (136) formed between a rear end of the nose member and the guide bar body, the space preferably defined by a notch (125) formed on one or both nose members.

As was shown in U.S. Pat. No. 2,693,206, if a replaceable nose member is slidingly fitted to a guide bar body and held by strong frictional forces, one preferable way to remove the nose member is to pry the nose member with an elongated tool such as a screwdriver or an awl that is inserted through an open hole disposed between the nose member and the bar body, the open hole formed by one or more cutouts in the contour where the side plates of the nose member meet the surface of the bar body. Preferred locations for such holes are at the rear end (25) of the tongues (14) of the side plates, and at the corners (19) where the tongues diverge from the transversal border (9) of the wider front region. The present invention has a great advantage compared to the U.S. Pat. No. 2,693,206, in that the strong frictional force only applies to a minor portion of the length that the nose member must slide to become free from the bar body in the present invention; in contrast, a press-fit along the whole length of the tongues as in U.S. Pat. No. 2,693,206 would require a strong force along the whole length, with the requirement of auxiliary tools and wasted time.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. Chainsaw guide bar comprising a guide bar body and a replaceable nose member, the nose member having two rearward tongues spaced apart in a thickness direction of the nose member, and the body having a web which fits between the tongues, wherein the nose member is held in place by an elastic snap-in coupling, the snap-in coupling comprising spring portions defined by indentations formed in respective ones of the tongues and projecting toward the web, the web including a cut-out arrangement for receiving the indentations, wherein the spring portions are elastically flexible in the thickness direction for enabling the indentations to be slidable into place and out of place without adding or removing any fastener element.

2. The chainsaw guide bar according to claim 1 wherein there is a plurality of indentations formed in each of the tongues, the cut-out arrangement comprising holes formed in the web, and positioned to receive the indentations.

3. The chainsaw guide bar according to claim 2 wherein each hole constitutes a through-hole which receives indentations from both of the tongues.

4. The chainsaw guide bar according to claim 2 wherein the nose member defines a longitudinal center axis, each tongue including indentations disposed on opposite sides of the axis.

5. The chainsaw guide bar according to claim 4 wherein each tongue further includes an indentation disposed on the axis.

6. The chainsaw guide bar according to claim 4 wherein the indentations on each tongue are aligned with respective indentations on the other tongue in the thickness direction.

7. The chainsaw guide bar according to claim 1 wherein a space is formed at an interface between the web and a rear end of the nose member for receiving a prying tool.

8. The chainsaw guide bar according to claim 7 wherein the space is defined by a notch formed in a tongue.

9. The chainsaw guide bar according to claim 1 further including a rivet interconnecting the tongues, the web including a slot for receiving the rivet.

10. Chainsaw guide bar comprising a guide bar body and a replaceable nose member, the nose member having two rearward tongues spaced apart in a thickness direction of the nose member, and the body having a web which fits between the tongues, the nose member defining a longitudinal center axis, wherein the nose member is held in place by an elastic snap-in coupling, the elastic snap-in coupling comprising a set of dimples formed in each of the tongues and projecting toward the web, the web including holes arranged to receive the dimples, each set of dimples comprising dimples disposed on respective sides of the axis, the dimples being elastically flexible in the thickness direction to permit the nose member to be slidable into place and out of place.

11. The chainsaw guide bar according to claim 10 wherein each hole constitutes a through-hole which receives dimples from both of the tongues.

12. The chainsaw guide bar according to claim 10 wherein each tongue further includes a dimple disposed on the axis.

13. The chainsaw guide bar according to claim 10 wherein the dimples on each tongue are aligned with respective dimples on the other tongue in the thickness direction.

14. The chainsaw guide bar according to claim 10 wherein a space is formed at an interface between the web and a rear end of the nose member for receiving a prying tool.

15. The chainsaw guide bar according to claim 10 wherein the space is defined by a notch formed in a tongue.

16. The chainsaw guide bar according to claim 10 further including a rivet interconnecting the tongues, the web including a slot for receiving the rivet.

17. Chainsaw guide bar comprising a guide bar body and a replaceable nose member, the nose member having two rearward tongues spaced apart in a thickness direction of the nose member, and the body having a web which fits between the tongues, wherein the nose member is held in place by an elastic snap-in coupling between elastically deformable spring portions of one of the members and rigid portions of the other member, wherein the nose member is slidable into place and out of place without adding or removing any fastener element, there being a space formed between a rear end of the nose member and the guide bar body for receiving a prying tool.

18. The chainsaw guide bar body according to claim 1 wherein a rear end of at least one of the tongues includes a notch for forming the space.

19. A nose member for a chainsaw guide bar, comprising a pair of plates secured together, with a rotatable sprocket wheel mounted between the plates, the nose member defining a longitudinal center axis, each plate including a tongue having a plurality of dimples formed therein on opposite sides of the axis, the tongues arranged in spaced apart superimposed relationship, with the dimples of each tongue projecting toward the other tongue.

20. The nose member according to claim 19 wherein the dimples of each tongue are aligned with respective dimples of the other tongue.

* * * * *